US006452994B2

(12) United States Patent
Pennington

(10) Patent No.: US 6,452,994 B2
(45) Date of Patent: Sep. 17, 2002

(54) SYSTEMS AND METHODS FOR STORING EXOTHERMIC MATERIALS

(75) Inventor: Charles W. Pennington, Alpharetta, GA (US)

(73) Assignee: NAC International, Inc., Norcross, GA (US)

( * ) Notice: Subject to any disclaimer, the term of this patent is extended or adjusted under 35 U.S.C. 154(b) by 0 days.

(21) Appl. No.: 09/748,333

(22) Filed: Dec. 21, 2000

Related U.S. Application Data

(60) Provisional application No. 60/175,442, filed on Jan. 11, 2000.

(51) Int. Cl.[7] ..... G21C 19/40; G21F 5/00

(52) U.S. Cl. ..... 376/272; 250/507.1; 250/518.1

(58) Field of Search ..... 376/172, 181, 376/423, 428, 435, 455, 271, 272, 285, 288; 250/506.1, 507.1, 517.1, 518.1

(56) References Cited

U.S. PATENT DOCUMENTS 3,104,219 A * 9/1963 Sulzer ..... 376/435
3,386,887 A * 6/1968 Mogard ..... 376/455
3,957,575 A * 5/1976 Fauth, Jr. et al. ..... 376/173
4,288,698 A * 9/1981 Baatz et al. ..... 250/506.1
4,393,510 A * 7/1983 Lang et al. ..... 376/172
4,594,513 A * 6/1986 Suzuki et al. ..... 220/560.03
4,743,423 A * 5/1988 Turner et al. ..... 250/515.1
4,781,883 A * 11/1988 Daugherty et al. ..... 376/272
4,827,139 A * 5/1989 Wells et al. ..... 250/507.1
5,545,796 A * 8/1996 Roy et al. ..... 250/506.1
5,926,516 A * 7/1999 Rudnick et al. ..... 250/518.1

* cited by examiner

*Primary Examiner*—Michael J. Carone
*Assistant Examiner*—David Matz
(74) *Attorney, Agent, or Firm*—Thomas, Kayden, Horstemeyer & Risley LLP

(57) ABSTRACT

A system for storing exothermic materials to enhance heat removal is provided that includes a first canister and a second canister. Preferably, the first canister incorporates a canister wall defining a first storage volume that is adapted to receive exothermic material therein. The second canister incorporates an inner wall and an outer wall, with the inner wall defining a canister-receiving, volume that is adapted to receive at least a portion of the first canister therein. Additionally, the outer wall and the inner wall may define a second storage volume which is adapted to receive exothermic material therein.

15 Claims, 2 Drawing Sheets

SYSTEMS AND METHODS FOR STORING EXOTHERMIC MATERIALS

CROSS-REFERENCE TO RELATED APPLICATIONS

This application is based on and claims priority to U.S. Provisional Application Serial No. 60/175,442, filed on Jan. 11, 2000, which is incorporated by reference herein in its entirety.

BACKGROUND OF THE INVENTION

1. Field of the Invention

The present invention generally relates to the storage of exothermic materials and, in particular, to systems and methods for storing exothermic materials that are adapted to maintain the stored materials at suitable temperatures.

2. Description of the Related Art

Exothermic materials inherently suffer from problems associated with their storage. For instance, nuclear fuel discharged from fission reactors, referred to hereinafter as Spent Nuclear Fuel (SNF), typically is stored in deep pools filled with water, with the water being provided to dissipate heat and to attenuate gamma and neutron radiation generated by the SNF. As an alternative to storing SNF in water-filled pools ("wet storage"), "dry storage" techniques also have been utilized.

In a typical dry-storage application, the SNF is stored in a substantially horizontal or substantially vertical configuration within a protective vessel which, typically, includes a heavy-walled structure referred to as a "cask" or "overpack." The aforementioned overpack provides, among other functions, radiation shielding and heat removal for the SNF. The overpack, therefore, typically is formed of heat resistant and shielding efficient material so that it can perform shielding and heat removal for extended time periods. However, since more and more SNF is envisioned as having high residual decay heat due to more extensive fissioning in the fuel during its operation in reactor, as well as shorter cooling times in deep water-filled pools, many prior art storage systems are not well suited for long-term storage of these materials.

Therefore, there is a need for improved systems and methods which address these and other shortcomings of the prior art.

SUMMARY OF THE INVENTION

Briefly described, the present invention relates to the storage of exothermic materials and, in particular, to systems and methods for storing exothermic materials that are adapted to maintain the stored materials at suitable temperatures. In a preferred embodiment, a system for storing exothermic materials is provided which includes a first canister and a second canister. Preferably, the first canister incorporates a canister wall defining a first storage volume that is adapted to receive exothermic material therein. The second canister incorporates an inner wall and an outer wall, with the inner wall defining a canister-receiving volume that is adapted to receive at least a portion of the first canister therein. Additionally, the outer wall and the inner wall may define a second storage volume which is adapted to receive exothermic material therein.

In another embodiment, a system for storing exothermic materials includes first means for storing exothermic material therein and second means for receiving at least a portion of the first means therein. Preferably, the second means also is adapted to receive exothermic material therein.

The present invention also may be construed as providing methods for storing exothermic materials. A preferred method includes the steps of: providing a first canister having a canister wall defining a first storage volume, the first storage volume being adapted to receive exothermic material therein; providing a second canister having an inner wall and an outer wall, the inner wall defining a canister-receiving volume adapted to receive at least a portion of the first canister therein, the outer wall and the inner wall defining a second storage volume therebetween; and inserting at least a portion of the first canister within the canister-receiving volume.

Other features and advantages of the present invention will become apparent to one with skill in the art upon examination of the following drawings and detailed description. It is intended that all such features and advantages be included herein within the scope of the present invention, as defined in the appended claims.

BRIEF DESCRIPTION OF THE SEVERAL VIEWS OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION OF THE PREFERRED EMBODIMENT

Reference will now be made in detail to the description of the invention as illustrated in as the drawings with like numerals indicating like parts throughout the several views. As described in detail hereinafter, the present invention provides systems and methods for storing exothermic material, such as spent nuclear fuel (SNF), among others. Although the present invention will be described herein in relation to the storage of SNF, it should be noted that applications of the teachings of the present invention are not so limited, with other such applications being considered well within the scope of the present invention.

Figure 1:
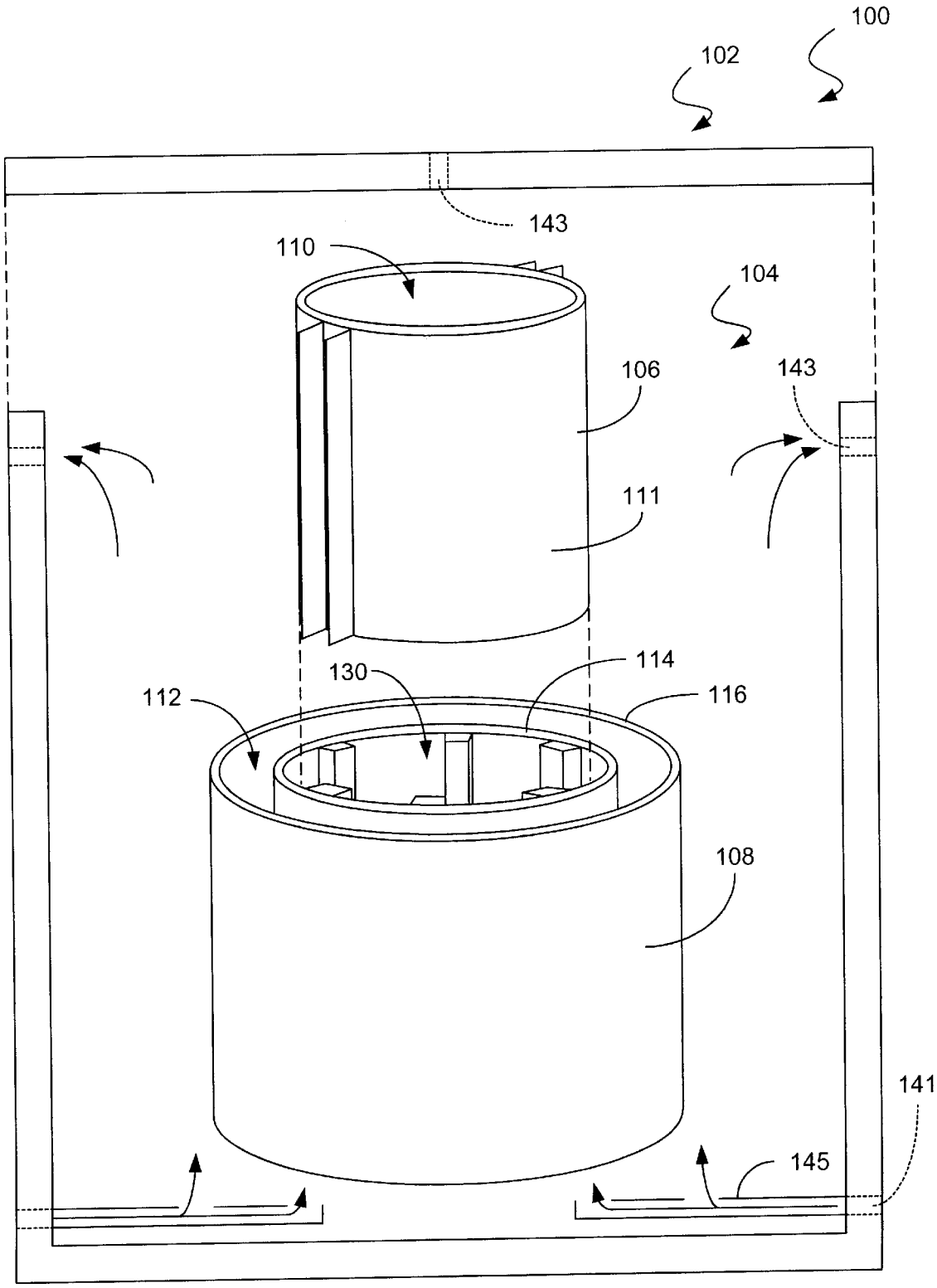
FIG. 1 is a schematic diagram depicting a preferred embodiment of the present invention.

As depicted in FIG. 1, a preferred embodiment of the storage system 100 of the present invention incorporates an overpack 102 (shown schematically) and a canister assembly 104, which includes an inner canister 106 and an outer canister 108. Preferably, the inner canister is cylindrically shaped and provides an inner storage volume 110 which is defined, at least in part, by canister wall 111. Although depicted in FIG. 1 as being cylindrically shaped, the inner canister as well as the outer canister may be provided in various shapes, provided the canisters may appropriately receive material for storage. Preferably, the outer canister provides an additional storage volume 112, which is adapted to be oriented about at least a portion of the inner storage volume 110. Storage volume 112 is defined, at least in part, by inner and outer walls 114 and 116, respectively, and a bottom (not shown). So configured, exothermic material, such as SNF, for example, may be stored within either or both of the storage volumes 110 and 112.

Figure 2:
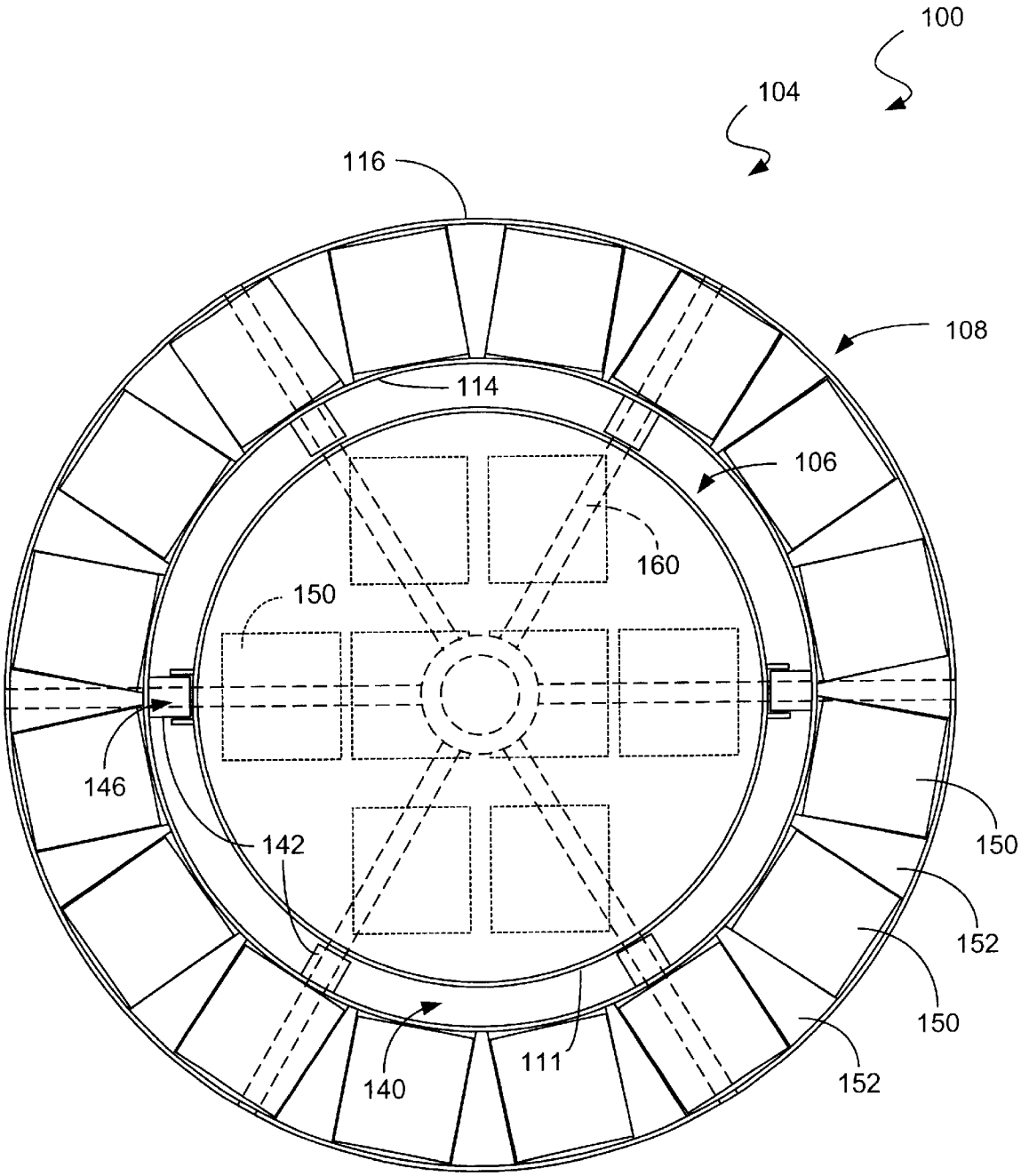
FIG. 2 is a top, schematic view of a preferred embodiment of the present invention.

Referring now to FIG. 2, canister assembly 104 will be described in greater detail. In the embodiment depicted in FIG. 2, inner canister 106 is provided with a cylindrical exterior shape and outer canister 108 is provided in an annular configuration. As mentioned hereinbefore, however, various other configurations of inner and outer canisters may be utilized, with all such shapes and configurations being considered well within the scope of the present invention. It is preferred, however, that the inner canister be adapted to be received within a canister-receiving volume 130 of the outer or second canister while allowing a sufficient volume or clearance for a cooling medium flow between the canisters.

In the embodiment depicted in FIG. 2, cooling medium flow between the canisters preferably is, at least partially, facilitated by one or more flow channels 140 which are provided between the first canister wall and the inner wall of the second canister. The outer wall of the second canister also may serve as a cooling surface over which cooling medium flow may be directed, e.g., an outer cooling medium flow channel(s) may be formed between the outer wall of the second canister and the overpack.

In some embodiments, cooling medium flows over the various walls of the canisters may be facilitated by one or more flow orifices (e.g., orifices 141 and 143 of FIG. 1). Such flow orifices may be formed through various portions of the overpack, such as through the overpack lid and/or sidewalls. Additionally, a support structure or pedestal (not shown) may be provided which is adapted to maintain the canisters in a spaced relationship with the bottom or floor of the overpack, thereby allowing a cooling medium to flow beneath the canisters. For instance, in the embodiment depicted in FIG. 1, a cooling medium may enter the overpack through flow orifice 141, and may be directed toward the canisters by conduit 145. So configured, the cooling medium, such as air, water or other heat removal agents, may flow across and between the various walls of the canisters and/or of the overpack, thereby potentially significantly increasing the effective heat transfer area, such as by more than fifty percent (50%), over prior art canister designs.

Flow channels 140 preferably are formed, at least in part, by spacers 142, which engage between the canisters and which maintain the canisters in a spaced configuration relative to each other, although various other configurations may be utilized. As depicted in the accompanying figures, one or more spacers may be suitably adapted to be received within an alignment channel 146 which, in addition to aiding in alignment of the inner canister within the canister-receiving volume, may prevent the inner canister from rotating about its longitudinal axis or, otherwise, jostling within the inner storage volume. It should be noted that spacers 142 are depicted as elongated components affixed to the inner wall of canister 108 and the alignment channels are depicted as elongated components affixed to the wall of canister 106; however, alternative configurations may be utilized. For example, the spacers may be affixed to the wall of canister 106 with the channels being formed on the inner wall of canister 108. As an additional example, the channels and spacers may be formed as less than full length segments engaging the various canisters.

Referring once again to FIG. 2, the outer canister 108 will now be described in greater detail. Preferably, outer canister 108 is adapted to store fuel assemblies 150 in a prescribed pattern between its inner and outer walls. In the embodiment depicted in FIG. 2, the annular shape of the outer canister typically results in the formation of wedge-shaped spaces 152 between the various fuel assemblies. Depending upon the particular application, spaces 152 may be retained as voids between the fuel assemblies or may be, at least partially, filled by a material for facilitating neutron moderation and absorption, shielding, cooling, positioning and/or protecting of the fuel assemblies. For instance, when the storage system is adapted for storing spent nuclear fuel, one or more of the spaces 152 may be occupied by a material containing neutron absorbers.

As described hereinbefore, the inner canister 106 is adapted to be received within a canister-receiving volume 130 of the outer canister 108. Maintaining the inner canister within the canister-receiving volume preferably is facilitated by the inner canister engaging a bottom structure of the outer canister. In the embodiment depicted in FIG. 2, such a bottom structure is provided in the form of an array of beams 160 (although various other configurations may be utilized) which are sufficiently durable so as to enable the inner canister to be supported and/or carried by the outer canister, such as during repositioning of the canisters, for instance. The array of beams configuration also provides the added benefit of allowing a cooling medium to flow upwardly through the beams and between the canisters, thereby promoting effective cooling of the storage system.

Depending upon the particular application, either or both of the inner and outer canisters may be provided with suitable lids for sealing materials stored by the canisters therein. In some applications, however, the use of one or more lids may not be desirable. For instance, and not for the purpose of limitation, while storing materials that produce gasses, sealing of such materials in a lidded canister may provide less than adequate venting from the canister of the produced gasses, thereby potentially compromising the structural integrity of the canister due to excess gas pressure created within the canister.

As described herein in relation to a preferred embodiment, storage system 100 potentially provides for high density storage of exothermic materials, e.g., SNF, while improving the heat transfer area typically provided by long-term dry storage applications. For example, extraction of one hundred percent (100%) to one hundred fifty percent (150%) or more heat from a given volume of canisterized fuel may be attained while maintaining the temperature of the material in and of the storage canisters at acceptable levels. Thus, the storage of very hot canisterized fuel may be accomplished without exceeding material, e.g., steel, concrete, neutron shielding, or SNF temperature limits.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. A system for storing exothermic materials, comprising:

a first canister adapted to store exothermic materials therein, comprising:

a first bottom wall;

a side wall extending from said first bottom wall such that said first bottom wall and said side wall form a first hollow structure having a first opening opposite said first bottom wall and defining a first storage volume that exothermic material can be inserted into and supported within; and at least one alignment channel affixed to and spanning at least partially along said side wall between said first bottom wall and said first opening at the exterior of said first hollow structure; and a second canister adapted to store exothermic materials therein, comprising:

a bottom support structure adapted to support said first canister when said first bottom wall of said first canister engages said bottom support structure and further adapted to provide at least one bottom opening through which a cooling medium is flowable;

an inner wall extending from said bottom support structure, said bottom support structure and said inner wall forming an inner hollow structure adapted to receive at least a portion of said first canister such that at least one open channel is defined between said inner wall of said inner hollow structure and said side wall of said first canister, said inner hollow structure having an inner opening opposite said bottom support structure;

a plurality of spacer columns affixed to and spanning at least partially along said inner wall between said bottom support structure and said inner opening at the interior of said inner hollow structure, said spacer columns being adapted to establish said at least one open channel;

an outer wall surrounding and spaced from said inner wall; and a second bottom wall extending between said outer wall and said inner wall such that said outer wall, said second bottom wall, and said inner wall form a second hollow structure having a second opening opposite said second bottom wall and defining a second storage volume that exothermic material can be inserted into and supported within, said first canister being maintainable in alignment with respect to said second canister by said alignment channel engaging at least one of said spacer columns.

2. The storage system of claim 1, wherein said side wall of said first canister and said inner wall of said second canister form a cooling medium flow channel therebetween when said first canister is received within said inner hollow structure of said second canister such that a cooling medium is flowable through said cooling medium flow channel from beneath said bottom support structure through said at least one bottom opening and through said at least one open channel, whereby at least a portion of heat transferred to said side wall of said first canister and said inner wall of said second canister from the exothermic material stored within said first canister is dissipated by the cooling medium flowing through said cooling medium flow channel.

3. The storage system of claim 1, wherein said side wall of said first canister and said inner wall of said second canister form a cooling medium flow channel therebetween when said first canister is received within said inner hollow structure of said second canister such that a cooling medium is flowable through said cooling medium flow channel from beneath said bottom support structure through said at least one bottom opening and through said at least one open channel, whereby at least a portion of heat transferred to said inner wall of said second canister and said side wall of said first canister from the exothermic material stored within said second canister is dissipated by the cooling medium flowing through said cooling medium flow channel.

4. The storage system of claim 1, wherein said first canister is cylindrically shaped.

5. The storage system of claim 1, wherein said outer wall and said inner wall of said second canister are cylindrically shaped such that said second storage volume is annularly shaped.

6. The storage system of claim 1, further comprising:

an overpack defining an overpack interior, said overpack interior being configured to receive said first and second canisters therein such that said overpack encases said first and second canisters.

7. The storage system of claim 1, further comprising:

an exothermic material inserted within said first storage volume of said first canister.

8. The storage system of claim 1, further comprising:

an exothermic material inserted within said second storage volume of said second canister.

9. The storage system of claim 2, wherein said cooling medium flow channel is formed, at least in part, by said spacer columns engaging between said side wall of said first canister and said inner wall of said second canister, each of said spacer columns being adapted to maintain a spaced configuration of a portion of said side wall of said first canister and said inner wall of said second canister.

10. The storage system of claim 6, wherein said outer wall of said second canister and said overpack are configured to form an outer cooling medium flow channel therebetween when said second canister is received within said overpack interior such that a cooling medium is flowable through said outer cooling medium flow channel, whereby at least a portion of heat transferred to said outer wall of said second canister from the exothermic material stored within said second canister is dissipated by the cooling medium flowing through said outer cooling medium flow channel.

11. The storage system of claim 7, wherein said exothermic material is nuclear waste.

12. The storage system of claim 9, wherein said spacer columns and said alignment channel engage each other such that rotation of said first canister about a longitudinal axis thereof is prevented.

13. The storage system of claim 1, wherein said bottom support structure comprises a plurality of beams arranged to support said first canister when said bottom wall of said first canister engages said beams.

14. The storage system of claim 8, wherein said exothermic material is nuclear waste.

15. The system of claim 1, wherein:

said first bottom wall and said side wall are adapted to transfer heat such that heat dissipated from the exothermic material stored within said first storage volume of said first canister is transferred out of said first storage volume through said first bottom wall and said side wall, and said inner wall, said outer wall, and said second bottom wall are adapted to transfer heat such that heat dissipated from the exothermic material stored within said second storage volume of said second canister is transferred out of said second storage volume through said inner wall, said outer wall, and said second bottom wall.

* * * * *